US006424328B1

(12) United States Patent
Ino et al.

(10) Patent No.: US 6,424,328 B1
(45) Date of Patent: Jul. 23, 2002

(54) LIQUID-CRYSTAL DISPLAY APPARATUS

(75) Inventors: Masumitsu Ino; Toshikazu Maekawa; Yoshiharu Nakajima; Hiroaki Ichikawa, all of Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/271,211

(22) Filed: Mar. 17, 1999

(30) Foreign Application Priority Data

Mar. 19, 1998 (JP) ..... 10-069625
Aug. 27, 1998 (JP) ..... 10-241393

(51) Int. Cl.[7] ..... G09G 3/30
(52) U.S. Cl. ..... 345/87; 345/92; 345/98; 345/100; 345/205; 345/88; 345/600; 345/603
(58) Field of Search ..... 345/87, 92, 204, 345/206, 211, 213, 100, 98, 88, 205, 600, 603

(56) References Cited

U.S. PATENT DOCUMENTS 5,781,164 A * 7/1998 Jacobsen et al. ..... 345/87
5,798,744 A * 8/1998 Tanaka et al. ..... 345/92
6,075,505 A * 6/2000 Shiba et al. ..... 345/87
6,160,535 A * 12/2000 Park ..... 345/100
6,175,351 B1 * 1/2001 Matsuura et all. ..... 345/98
6,268,841 B1 * 7/2001 Cairns et al. ..... 345/98
6,310,592 B1 * 10/2001 Moon et al. ..... 345/87

* cited by examiner

*Primary Examiner*—Richard Hjerpe
*Assistant Examiner*—Ali Zamani
(74) *Attorney, Agent, or Firm*—Rader, Fishman & Grauer LLP; Ronald P. Kananen, Esq.

(57) ABSTRACT

When time-division driving, which allows the number of output pins of a driver IC to be reduced, is applied to an active-matrix LCD apparatus, a time-division number is set to an odd number, preferably to the n-th (n: natural number) power of three, and a time-sequential signal (dot inversion signal) output from the driver IC is time-divided by a time-division switch and sent to signal lines 12-1, 12-2, 12-3, . . . to implement complete dot inversion driving.

17 Claims, 14 Drawing Sheets

| | A1 | | | | | | | | | B1A2 | | | | | | | | | B2A3 | | | | | | | | B3 |
|---|---|---|---|---|---|---|---|---|---|---|---|---|---|---|---|---|---|---|---|---|---|---|---|---|---|---|---|
| 1 | H | L | H | | | | | | | L | H | L | | | | | | | H | L | H | | | | | | |
| 2 | | | | L | H | L | | | | | | | H | L | H | | | | | | | L | H | L | | | |
| 3 | | | | | | | H | L | H | | | | | | | L | H | L | | | | | | | H | L | H |
| 1 | L | H | L | | | | | | | H | L | H | | | | | | | L | H | L | | | | | | |
| 2 | | | | H | L | H | | | | | | | L | H | L | | | | | | | H | L | H | | | |
| 3 | | | | | | | L | H | L | | | | | | | H | L | H | | | | | | | L | H | L |
| 1 | H | L | H | | | | | | | L | H | L | | | | | | | H | L | H | | | | | | |
| 2 | | | | L | H | L | | | | | | | H | L | H | | | | | | | L | H | L | | | |
| 3 | | | | | | | H | L | H | | | | | | | L | H | L | | | | | | | H | L | H |
| 1 | L | H | L | | | | | | | H | L | H | | | | | | | L | H | L | | | | | | |
| 2 | | | | H | L | H | | | | | | | L | H | L | | | | | | | H | L | H | | | |
| 3 | | | | | | | L | H | L | | | | | | | H | L | H | | | | | | | L | H | L |

| | A1 | | B1 | A2 | | B2 | A3 | | B3 | | | | | | | | | | | | | | | | | | | |
|---|---|---|---|---|---|---|---|---|---|---|---|---|---|---|---|---|---|---|---|---|---|---|---|---|---|---|---|---|
| 1 | H | | | L | | | H | | | L | | | H | | | L | | | H | | | L | | | H | | |
| 2 | | L | | | H | | | L | | | H | | | L | | | H | | | L | | | H | | | L | |
| 3 | | | H | | | L | | | H | | | L | | | H | | | L | | | H | | | L | | | H |
| 1 | L | | | H | | | L | | | H | | | L | | | H | | | L | | | H | | | L | | |
| 2 | | H | | | L | | | H | | | L | | | H | | | L | | | H | | | L | | | H | |
| 3 | | | L | | | H | | | L | | | H | | | L | | | H | | | L | | | H | | | L |
| 1 | H | | | L | | | H | | | L | | | H | | | L | | | H | | | L | | | H | | |
| 2 | | L | | | H | | | L | | | H | | | L | | | H | | | L | | | H | | | L | |
| 3 | | | H | | | L | | | H | | | L | | | H | | | L | | | H | | | L | | | H |
| 1 | L | | | H | | | L | | | H | | | L | | | H | | | L | | | H | | | L | | |
| 2 | | H | | | L | | | H | | | L | | | H | | | L | | | H | | | L | | | H | |
| 3 | | | L | | | H | | | L | | | H | | | L | | | H | | | L | | | H | | | L |

| | A1 | | | | | | | | B1 | A2 | | | | | | | | B2 | | | | | | | | | |
|---|---|---|---|---|---|---|---|---|---|---|---|---|---|---|---|---|---|---|---|---|---|---|---|---|---|---|---|
| 1 | H | | | | | | | | | L | | | | | | | | | H | | | | | | | | |
| 2 | | L | | | | | | | | | H | | | | | | | | | L | | | | | | | |
| 3 | | | H | | | | | | | | | L | | | | | | | | | H | | | | | | |
| 4 | | | | L | | | | | | | | | H | | | | | | | | | L | | | | | |
| 5 | | | | | H | | | | | | | | | L | | | | | | | | | H | | | | |
| 6 | | | | | | L | | | | | | | | | H | | | | | | | | | L | | | |
| 7 | | | | | | | H | | | | | | | | | L | | | | | | | | | H | | |
| 8 | | | | | | | | L | | | | | | | | | H | | | | | | | | | L | |
| 9 | | | | | | | | | H | | | | | | | | | L | | | | | | | | | H |
| 1 | L | | | | | | | | | H | | | | | | | | | L | | | | | | | | |
| 2 | | H | | | | | | | | | L | | | | | | | | | H | | | | | | | |
| 3 | | | L | | | | | | | | | H | | | | | | | | | L | | | | | | |
| 4 | | | | H | | | | | | | | | L | | | | | | | | | H | | | | | |
| 5 | | | | | L | | | | | | | | | H | | | | | | | | | L | | | | |
| 6 | | | | | | H | | | | | | | | | L | | | | | | | | | H | | | |
| 7 | | | | | | | L | | | | | | | | | H | | | | | | | | | L | | |
| 8 | | | | | | | | H | | | | | | | | | L | | | | | | | | | H | |
| 9 | | | | | | | | | L | | | | | | | | | H | | | | | | | | | L |

| | A1 | | | | B1 | A2 | | | | B2 | | | | | | | | | | | | | | | | |
|---|---|---|---|---|---|---|---|---|---|---|---|---|---|---|---|---|---|---|---|---|---|---|---|---|---|---|
| 1 | H | | | | | L | | | | | H | | | | | L | | | | | H | | | | | L | |
| 2 | | L | | | | | H | | | | | L | | | | | H | | | | | L | | | | | H |
| 3 | | | H | | | | | L | | | | | H | | | | | L | | | | | H | | | | |
| 4 | | | | L | | | | | H | | | | | L | | | | | H | | | | | L | | | |
| 5 | | | | | H | | | | | L | | | | | H | | | | | L | | | | | H | | |
| 1 | L | | | | | H | | | | | L | | | | | H | | | | | L | | | | | H | |
| 2 | | H | | | | | L | | | | | H | | | | | L | | | | | H | | | | | L |
| 3 | | | L | | | | | H | | | | | L | | | | | H | | | | | L | | | | |
| 4 | | | | H | | | | | L | | | | | H | | | | | L | | | | | H | | | |
| 5 | | | | | L | | | | | H | | | | | L | | | | | H | | | | | L | | |
| 1 | H | | | | | L | | | | | H | | | | | L | | | | | H | | | | | L | |
| 2 | | L | | | | | H | | | | | L | | | | | H | | | | | L | | | | | H |
| 3 | | | H | | | | | L | | | | | H | | | | | L | | | | | H | | | | |
| 4 | | | | L | | | | | H | | | | | L | | | | | H | | | | | L | | | |
| 5 | | | | | H | | | | | L | | | | | H | | | | | L | | | | | H | | |
| 1 | L | | | | | H | | | | | L | | | | | H | | | | | L | | | | | H | |
| 2 | | H | | | | | L | | | | | H | | | | | L | | | | | H | | | | | L |
| 3 | | | L | | | | | H | | | | | L | | | | | H | | | | | L | | | | |

LIQUID-CRYSTAL DISPLAY APPARATUS

BACKGROUND OF THE INVENTION

1. Field of the Invention

The present invention relates to liquid-crystal display (LCD) apparatuses, and more particularly, to an active-matrix liquid-crystal display apparatus using time-division driving.

2. Description of the Related Art

Active-matrix liquid-crystal display (LCD) apparatuses have been mainly used in personal computers and word processing units. Active-matrix LCD apparatuses are superior in terms of response speed and image quality, and are best suited to in improving recent color display. In such a display apparatus, a nonlinear device such as a transistor and diode is used in each pixel of the LCD panel. Specifically, thin film transistors (TFTs) are formed on a transparent insulating substrate such as a glass substrate.

For active-matrix LCD apparatuses, it is said that a so-called dot-inversion driving method, in which the polarities of voltages to be applied to adjacent dots (pixels) are inverted, is good in improving image quality. This is because inverting the polarities of voltages to be applied to adjacent dots cancels potentials jumped from signal lines, which are caused by capacitors formed at the crossover points of signal lines and gate lines, and thereby stable pixel potentials are input to reduce flickers in LCD display.

On the other hand, if the dot-inversion driving method is not employed, the ground level of gate lines fluctuates and thereby the gate switches of TFTs cannot hold off states. Consequently, held pixel potentials are discharged. The transmission factors of pixels decrease and their contrast is also reduced. In addition, since potentials having the same polarity are jumped from signal lines, pixel contrast becomes conspicuous between alternate lines. Even if an image having the same graduation is displayed, different graduations are shown in alternate lines.

Since the dot-inversion driving method solves these inconveniences, it is an effective driving method for LCD apparatuses to improve image quality.

The outputs of an external driver IC for driving an LCD panel usually correspond to the signal lines of the LCD panel in a one-to-one correspondence relationship. In other words, each output of the driver IC is sent to the corresponding signal line. On the other hand, to make the driver IC compact, there has been known a so-called time-division driving method as an LCD-panel driving method which allows the number of the output pins (output terminals) of the driver IC to be reduced.

In this time-division driving method, a plurality of signal lines are handled as one block, a driver IC outputs a signal to a plurality of signal lines in one division block in a time sequential manner, time-division switches are provided for an LCD panel in units of division blocks, and the time-sequential signal output from the driver IC is time-divided by the time-division switches and sequentially sent to a plurality of signal lines.

When time-division driving is applied to a general driver IC used for dot-inversion driving, however, since the output signals of the driver IC used for dot-inversion driving change their polarities between odd-numbered lines and even-numbered lines, it may occur that dot-inversion driving cannot be used in time-division driving. With divided-by-two time-division driving being taken as an example, this issue will be described below.

As an example of divided-by-two time-division driving, a system shown in FIG. 17 is formed such that two adjacent signal lines 71-1 and 71-2, 71-3 and 71-4, . . . are handled as blocks irrespective of the corresponding colors, red (R), green (G), and blue (B), and the time-division switches 72-1 and 72-2, 72-3 and 72-4, . . . connected to these signal lines divide in time time-sequential signals sent through output lines 73-1, 73-2, . . . from a not-shown driver IC and sequentially send to the signal lines 71-1 and 71-2, 71-3 and 71-4, . . .

In divided-by-two time-division driving in the system configured as described above, since signal voltages inverted in polarity between odd-numbered and even-numbered output terminals of the driver IC are distributed to odd-numbered and even-numbered actual pixels and their polarities are inverted in alternate lines, it is clear from FIG. 18, which shows signal-voltage write conditions, that the polarities of the voltages applied to adjacent pixels in one line cannot be inverted in the entire pixel area, namely, dot inversion cannot be achieved in the entire pixel area.

In FIG. 18, the horizontal direction indicates a scanning order and the vertical direction indicates the order in which the time-division switches operate. A high-voltage write condition is indicated by H, and a low-voltage write condition is indicated by L.

As another example of divided-by-two time-division driving, a system shown in FIG. 19 is formed such that two adjacent signal lines 81-1 and 81-4, 81-2 and 81-5, 81-3 and 81-6, . . . for each color of R, G, and B are handled as blocks, and the time-division switches 82-1 and 82-4, 82-2 and 82-5, 82-3 and 82-6, . . . connected to these signal lines divide in time time-sequential signals sent through output lines 83-1, 83-2, . . . from a not-shown driver IC and sequentially send to the signal lines 81-1 and 81-4, 81-2 and 81-5, 81-3 and 81-6, . . .

In divided-by-two time-division driving in the system configured as described above, since signal voltages inverted in polarity between odd-numbered and even-numbered output terminals of the driver IC are distributed to odd-numbered and even-numbered actual pixels and their polarities are inverted in alternate lines, it is clear from FIG. 20, which shows signal-voltage write conditions, that dot inversion cannot be achieved at boundaries of division blocks in one line. Since the definition of dot inversion does not cover the case which happened at the boundaries of the division blocks, pixel potentials fluctuate and vertical lines appear.

In FIG. 20, the horizontal direction indicates a scanning order and the vertical direction indicates the order in which the time-division switches operate. A high-voltage write condition is indicated by H, and a low-voltage write condition is indicated by L.

In other words, when a time-division number is even, the polarity of the signal voltage A first written in a division block is opposite that of the signal voltage B last written in FIGS. 18 and 20. Since signal voltages sent from the driver IC are inverted between odd-numbered dots and even-numbered dots, signal voltages B1, B2, . . . written last in division blocks have the same polarities as signal voltages A2, A3, . . . written first in the following division blocks.

Therefore, in the first example of divided-by-two time-division driving, dot inversion cannot be achieved in the entire pixel area, and in the second example of divided-by-two time-division driving, dot inversion cannot be achieved at the boundaries of division blocks. Hence, image quality is reduced. Polarity inversion, however, can be achieved with chroma signals being rotated. As will be described later, this makes data re-arrangement processing complicated and increases the size of a processing circuit.

SUMMARY OF THE INVENTION

The present invention has been made in consideration of the above inconveniences. Accordingly, it is an object of the present invention to provide an LCD apparatus which allows time-division driving to be implemented without reducing image quality.

The foregoing object is achieved according to the present invention through the provision of a liquid-crystal display apparatus including: a display section formed of a plurality of row gate lines, a plurality of column signal lines, and a plurality of pixels two-dimensionally arranged at the intersections of the plurality of row gate lines and the plurality of column signal lines; a transparent substrate on which the display section is formed; a second transparent substrate having an opposite electrode, connected to the transparent substrate with a predetermined gap placed therebetween; liquid crystal held in the gap; a driver circuit for outputting a time-sequential signal corresponding to a predetermined time-division number; and a time-division switch for time-dividing the time-sequential signal output from the driver circuit and for sending them to the corresponding signal lines among the plurality of column signal lines, wherein the time-division number used in the time-division switch is set odd.

In the LCD apparatus having the above configuration, the driver circuit outputs a time-sequential signal corresponding to the time division number to allow time-division driving. The time-sequential signals, for example, in dot-inversion driving, are signals having different polarities alternately (dot-inversion signals). Time-division switches apply time division to the time-sequential signals with an odd time-division number and send them to the corresponding signal lines. With this operation, the voltages applied to adjacent pixels in one line do not have the same polarity, and dot inversion driving is achieved in the entire pixel area.

DESCRIPTION OF THE PREFERRED EMBODIMENTS

Figure 1:
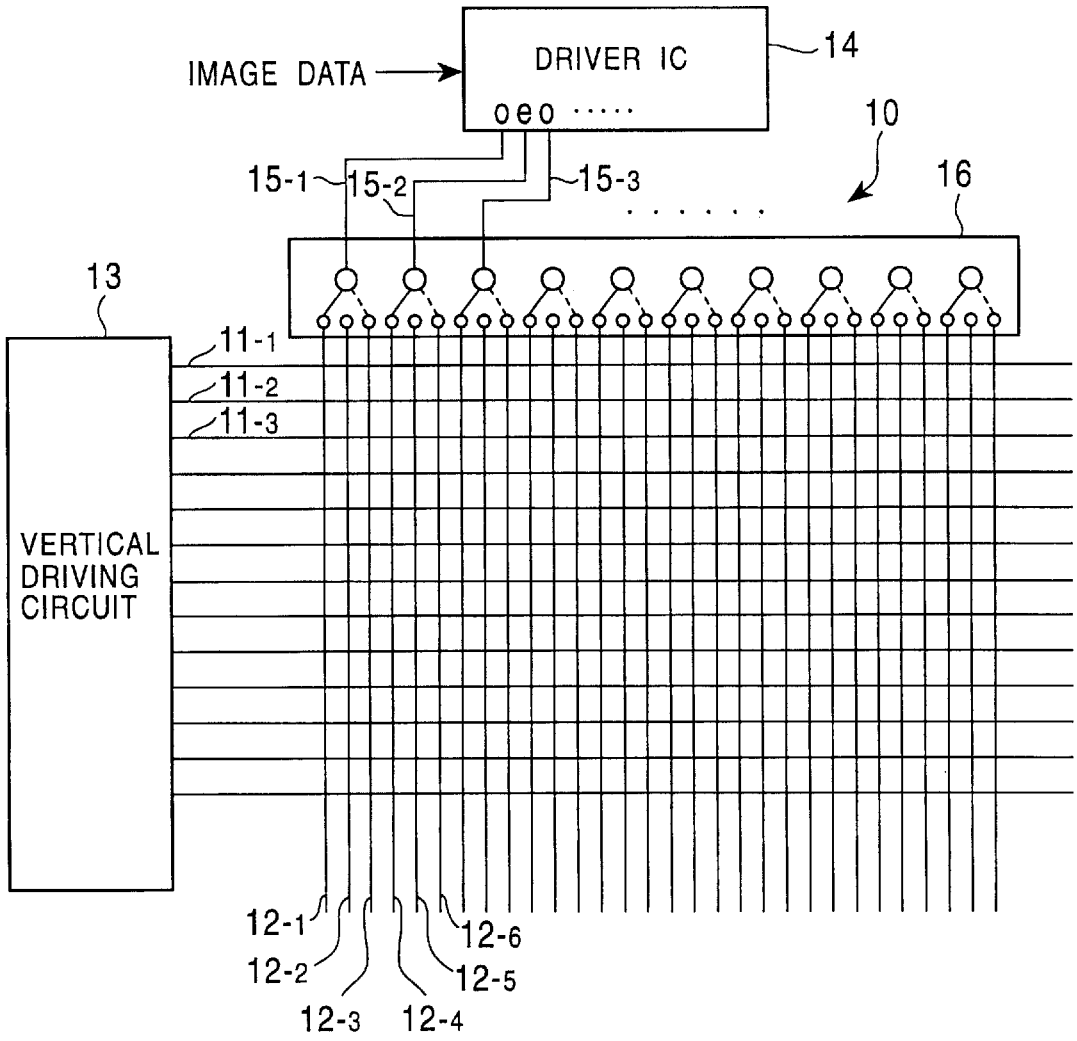
FIG. 1 is a wiring diagram of a liquid-crystal display section in an active-matrix liquid-crystal display apparatus according to the present invention.

Embodiments of the present invention will be described in detail by referring to the drawings. FIG. 1 is a wiring diagram of a liquid-crystal display section of an active-matrix liquid-crystal display (LCD) apparatus according to a first embodiment of the present invention.

In the active-matrix LCD apparatus according to the first embodiment, a plurality of row gate lines 11-1, 11-2, 11-3, . . . and a plurality of column signal lines 12-1, 12-2, 12-3, . . . are arranged in matrix on a transparent substrate made, for example, from glass, and a back light formed, for example, of a cold-cathode tube is disposed at the rear side of the transparent substrate. Pixels are disposed at the intersections of the gate lines 11-1, 11-2, 11-3, . . . made, for example, from polycrystalline silicon, and the signal lines 12-1, 12-2, 12-3, . . . made, for example, from Aluminum to form a LCD panel (display section) 10. The configuration of the pixels will be described below.

One end of each of the plurality of row gate lines 11-1, 11-2, 11-3, . . . is connected to the output end in the corresponding row of a vertical driving circuit 13. The vertical driving circuit 13 is disposed on the same substrate as the LCD panel 10, and sequentially sends selection pulses to the gate lines 11-1, 11-2, 11-3, . . . to select pixels in units of rows for vertical scanning.

A driver IC 14 is provided as an external circuit of the LCD panel 10 and sends signal potentials to the signal lines 12-1, 12-2, 12-3, . . . according to an image data. Digital image data which allows display with eight or more graduations and 512 colors or more, for example, is input to the driver IC 14. A general dot-inversion driving IC is used as the driver IC 14. The driver IC 14 outputs signal voltages in which the potentials are inverted between odd-numbered dots and even-numbered dots to implement dot-inversion driving.

In addition, to implement time-division driving, the driver IC 14 time-sequentially outputs signals to pluralities of signal lines with a plurality of signal lines being handled as one block. A time-division switch section 16 is provided between the output lines 15-1, 15-2, 15-3, . . . of the driver IC 14 and the signal lines 12-1, 12-2, 12-3, . . . The configurations of the driver IC 14 and the time-division switch section 16 will be described later.

Figure 2:
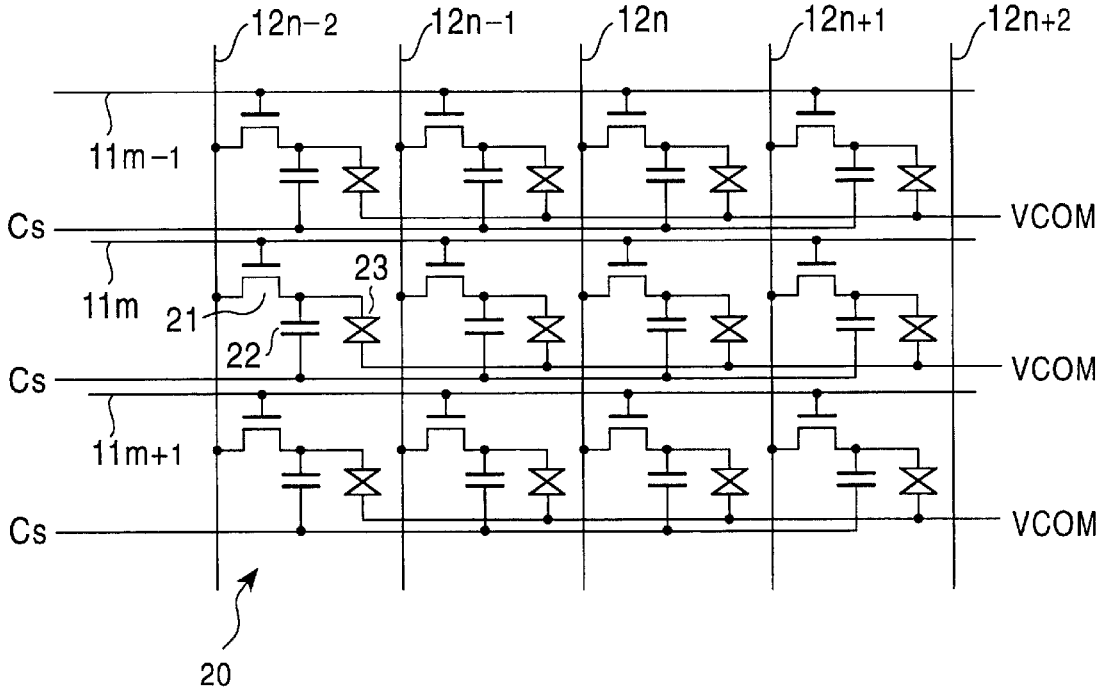
FIG. 2 is a circuit diagram of pixels.

FIG. 2 is a circuit diagram of pixels. As clearly shown in the figure, each pixel 20 is formed of a thin film transistor 21, an additional capacitor 22, and a liquid-crystal capacitor 23. The thin film transistors 21 are connected to gate lines 11*m*−1, 11*m*, 11*m*+1, . . . at their gate electrodes and connected to signal lines (source lines) 12*n*−1, 12*n*, 12*n*+1, . . . at their source electrodes.

In this pixel structure, the liquid-crystal capacitor 23 indicates a capacitor generated between a pixel electrode formed of the thin film transistor 21 and the opposite electrode formed correspondingly. An "H" potential or an "L" potential is written into and held at the pixel electrode, where "H" indicates a high-voltage write condition and "L" indicates a low-voltage write condition.

The potential (common potential Vcom) of the opposite electrode is, for example, set to a DC potential of 6 V and a signal voltage is periodically changed between a high voltage "H" and a low voltage "L" at an interval of one field to implement alternate liquid-crystal driving. The alternate driving reduces polarization of liquid-crystal molecules and prevents the liquid-crystal molecules or an insulating film made, for example, from organic macromolecules and disposed at an electrode surface from being charged.

In the pixel 20, when the thin film transistor 21 is turned on, the optical transmission factor of the pixel changes and the additional capacitor 22 is charged. With this charging, even if the thin film transistor 21 is turned off, the optical transmission factor of the pixel set by the charged voltage of the additional capacitor 22 is maintained until the thin film transistor 21 is turned on next time. With this method, the quality of an image displayed on the LCD panel 10 is improved.

Figure 3:
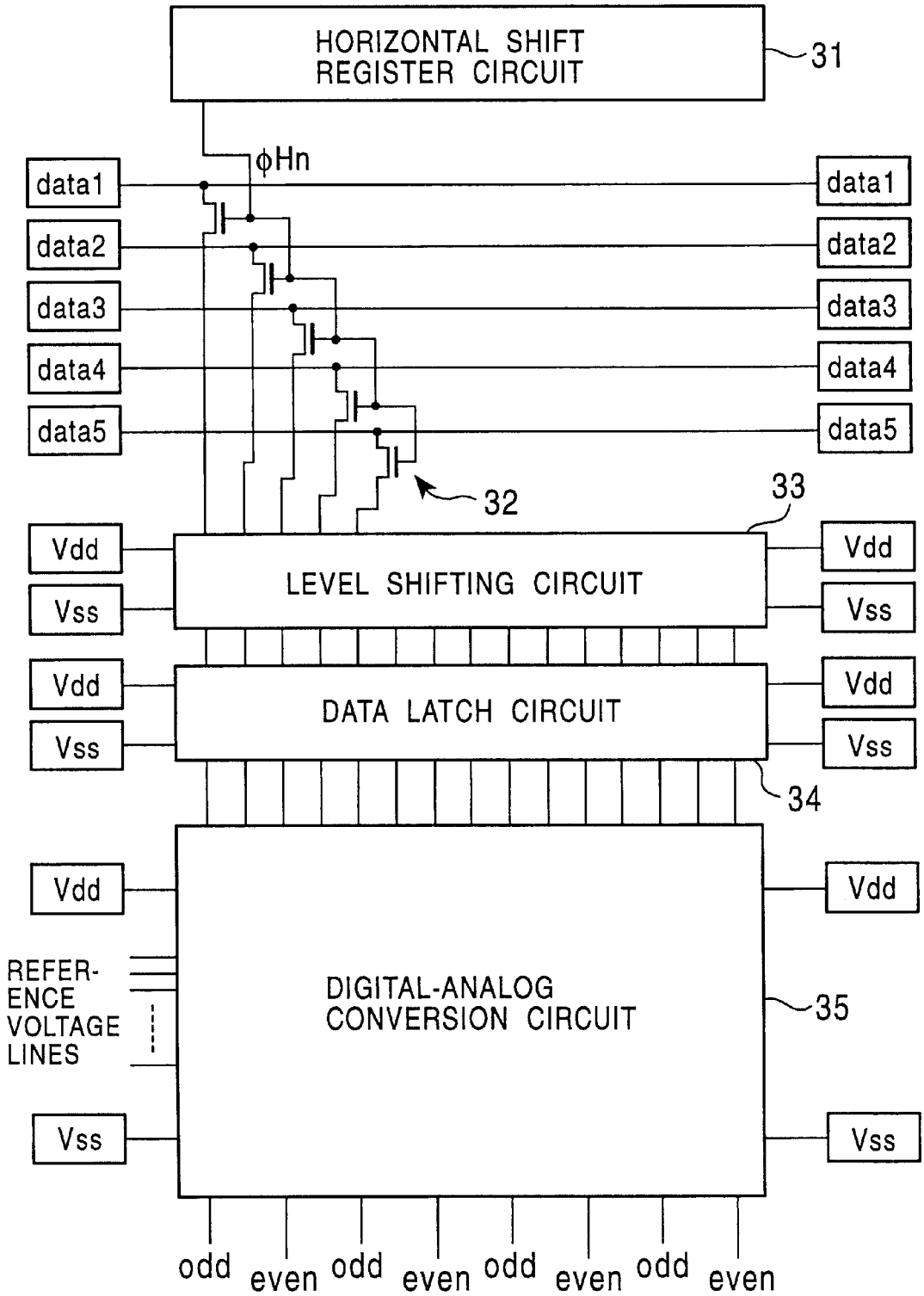
FIG. 3 is a block diagram of a configuration example of a driver IC.

FIG. 3 is a block diagram of a configuration example of the driver IC 14. As clearly shown in FIG. 3, the driver IC 14 includes a horizontal shift register circuit 31, a sampling switch set 32, a level shifting circuit 33, a data latch circuit 34, and a digital-analog conversion circuit 35. In this example, five-bit digital image data, data1 to data5, and power voltages Vdd and Vss, for example, are input to the horizontal shift register circuit 31 in both shift directions.

In the driver IC 14 configured as described above, the horizontal shift register circuit 31 sequentially outputs a horizontal scanning pulse to perform horizontal scanning (row scanning). Each sampling switch in the sampling switch set 32 sequentially samples the input digital image data data1 to data5 according to the corresponding horizontal scanning pulse sent from the horizontal shift register circuit 31.

The level shifting circuit 33 increases in voltage the 5-V digital data, for example, sampled by the sampling switch set 32 to digital data having a liquid-crystal driving voltage. The data latch circuit 34 is a memory that accumulates the digital data of which the voltage has been increased by the level shifting circuit 33, for one horizontal scanning period. The digital-analog conversion circuit 35 converts the digital data for one horizontal scanning period output from the data latch circuit 34 to an analog signal and outputs it.

The driver IC 14 outputs dot-inversion signals in which the polarities are inverted between odd-numbered output terminals and even-numbered output terminals and the polarities are further inverted every one horizontal scanning period (1H) to implement the above-described dot-inversion driving. The driver IC 14 time-sequentially outputs signals from the output terminals to the signal lines with a plurality of signal lines in the LCD panel 10 being handled as one block to implement time-division driving.

A first embodiment of the present invention to which dot-inversion driving is applied will be described below.

Figures 4, 5:
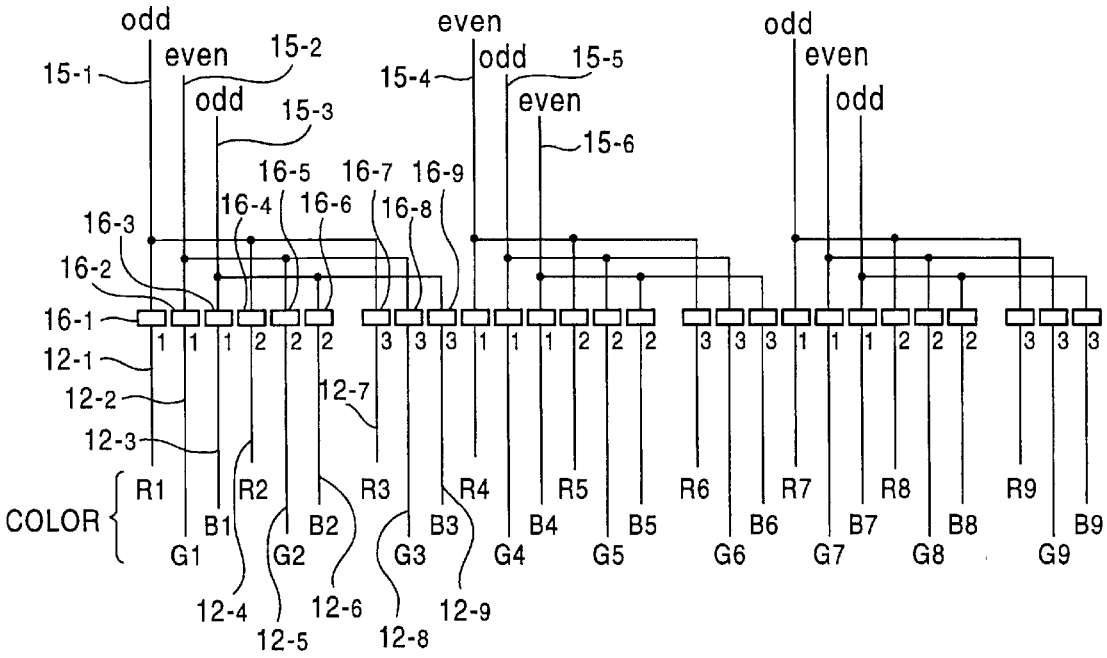
FIG. 4 is a configuration view showing the connections of time-division switches in first divided-by-three time-division driving according to a first embodiment.
FIG. 5 is a view showing signal-voltage write conditions on pixels in the first divided-by-three time-division driving.

FIG. 4 is a configuration view showing a first example of the connections of the time-division switch section 16. This view, for example, shows a first example applied to divided-by-three time-division driving corresponding to R, G, and B. In this example, the driver IC 14 time-sequentially outputs signals from the output terminals through the output lines 15-1, 15-2, 15-3, . . . with one signal corresponding to adjacent three pixels in the same color, R, G, or B, namely three every third pixels.

Figure 6:
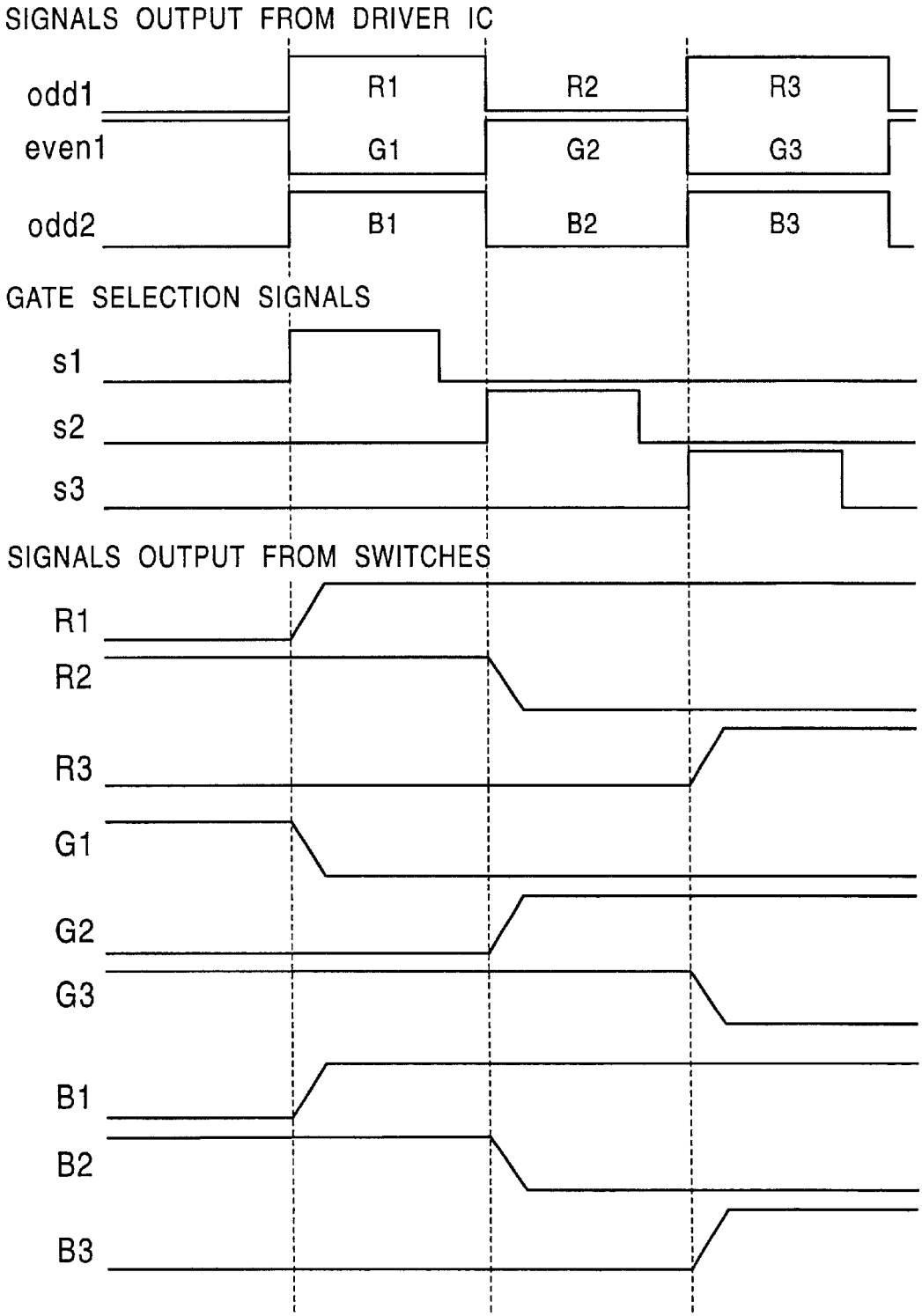
FIG. 6 is a timing chart of each signal in the first divided-by-three time-division driving.

Specifically, as shown in a timing chart of FIG. 6, the driver IC 14 outputs a signal for R1, R2, and R3 pixels from an odd-numbered output terminal through the output line 15-1, a signal for G1, G2, and G3 pixels from an even-numbered output terminal through the output line 15-2, a signal for B1, B2, and B3 pixels from an odd-numbered output terminal through the output line 15-3, . . .

Time-division switches 16-1, 16-4, and 16-7 are provided between the output line 15-1 and three signal lines 12-1, 12-4, and 12-7, time-division switches 16-2, 16-5, and 16-8 are provided between the output line 15-2 and three signal lines 12-2, 12-5, and 12-8, time-division switches 16-3, 16-6, and 16-9 are provided between the output line 15-3 and three signal lines 12-3, 12-6, and 12-9, . . .

Figure 7A:
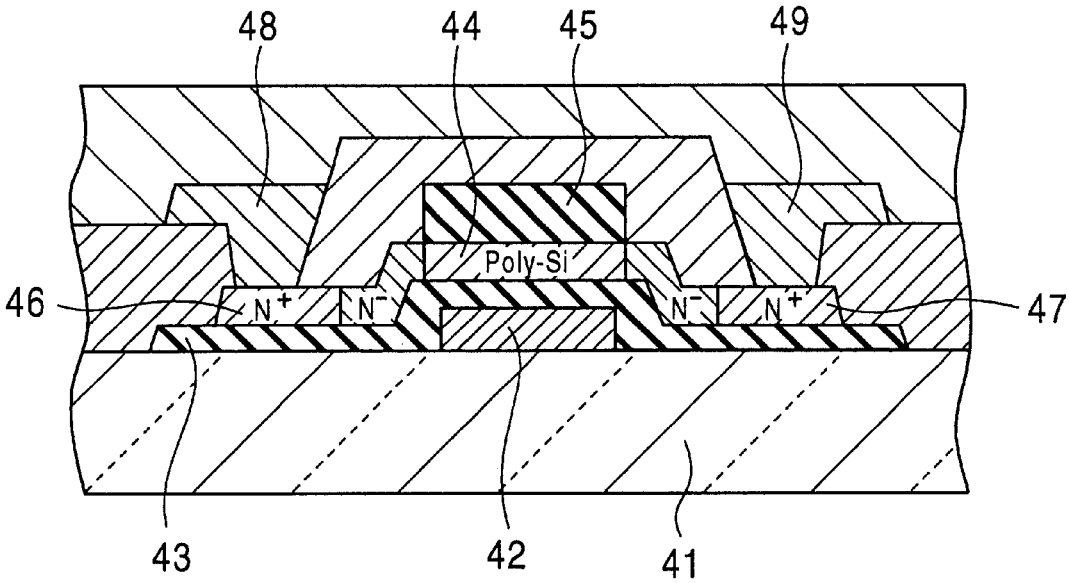
FIG. 7A is a structural cross section of a thin film transistor having a bottom gate structure.
Figure 7B:
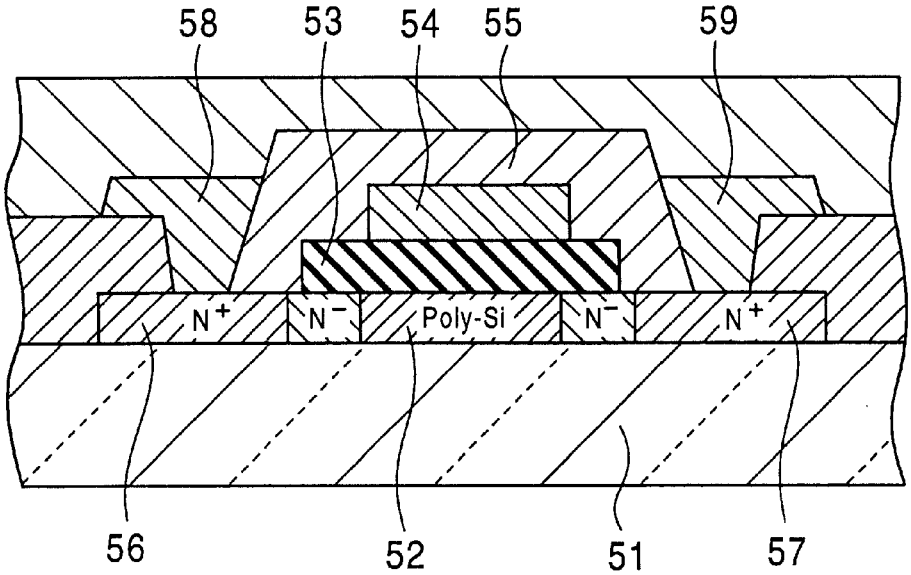
FIG. 7B is a structural cross section of a thin film transistor having a top gate structure.

These time-division switches 16-1, 16-4, 16-7, 16-2, 16-5, 16-8, 16-3, 16-6, 16-9, . . . are formed in the LCD panel 10 together with pixel switches (transistors) and transistors constituting the vertical driving circuit 13, by polycrystalline TFTs having, for example, a bottom gate structure shown in FIG. 7A or a top gate structure shown in FIG. 7B.

In a TFT having the bottom gate structure shown in FIG. 7A, a gate electrode 42 made, for example, from Mo is formed on a glass substrate 41, a polycrystalline silicon (poly-Si) layer 44 is formed thereon through a gate insulating film 43 made, for example, from $SiO_2$, and an inter-layer insulating film 45 made, for example, from $SiO_2$ is further formed thereon. On the gate insulating film 43 positioned at the sides of the gate electrode 42, a source area 46 and a drain area 47 formed of $N^+$ diffusion layers are disposed. A source electrode 48 and a drain electrode 49 made, for example, from aluminum are connected to the areas 46 and 47, respectively.

In a TFT having the top gate structure shown in FIG. 7B, a polycrystalline silicon layer 52 is formed on a glass substrate 51, a gate electrode 54 is formed thereon through a gate insulating film 53 made, for example, from $SiO_2$, and an inter-layer insulating film 55 made, for example, from $SiO_2$ is further formed thereon. At the sides of the polycrystalline silicon layer 52 on the glass substrate 51, a source area 56 and a drain area 57 formed of $N^+$ diffusion layers are disposed. A source electrode 58 and a drain electrode 59 made, for example, from aluminum are connected to the areas 56 and 57, respectively.

These time-division switches 16-1, 16-4, 16-7, 16-2, 16-5, 16-8, 16-3, 16-6, 16-9, . . . are sequentially turned on according to gate selection signals s1, s2, and s3 (see the timing chart of FIG. 6) sent from the outside to divide by three in one horizontal scanning period time-sequential signals output from the driver IC 14 through the output lines 15-1, 15-2, 15-3, . . . and to send them to the corresponding signal lines.

In this way, signal potentials which, for example, allow display with eight or more graduations and 512 colors or more are sent from the driver IC 14 to the signal lines 12-1, 12-2, 12-3, . . . through the output lines 15-1, 15-2, 15-3, . . . and the time-division switches 16-1, 16-2, 16-3, . . . In this case, the time-sequential signals output from the external driver IC 14 are sent to the time-division switches 16-1, 16-2, 16-3, . . . in the order of R, G, and B.

A time-division number should be odd, and is preferably the n-th power of three (n: natural number) or a multiple of three. This is because, since one pixel is formed of three R, G, and B dots, the R1, R2, and R3 pixel outputs can correspond to odd-numbered outputs and even-numbered outputs inverted each other and sent from the external driver IC 14. It is a matter of course that this also applies to G1, G2, and G3, and B1, B2, and B3.

It is also clear from the above descriptions that the driver IC 14 outputs R, G, and B signals in synchronization from the corresponding output terminals to the output lines 15-1, 15-2, 15-3, . . . Therefore, the signal potentials output from the external driver IC 14 do not need to be rotated. In addition, without re-arranging data complicatedly, data can be re-arranged successively. Therefore, memory control for data re-arrangement can be made simple.

Signal rotation refers to a state in which R, G, and B signals are not output in synchronization, but output in the order of R, G, and B from a certain output terminal, output in the order of G, B, and R from another output terminal, and output in the order of B, R, and G from yet another output terminal. To allow this, color-signal data needs to be re-arranged in advance before input to the driver IC 14, and to be accumulated in a buffer memory.

As described above, the signal voltages output from the driver IC 14 inverted in polarity between the odd-numbered output terminals and the even-numbered output terminals are distributed to actual pixel odd-numbered lines and even-numbered lines, and the polarity is inverted in each line. In a case of divide-by-three time-division driving, since a time-division number is odd, signal voltages B1, B2, . . . written last into division blocks have different polarities from signal voltages A2, A3, . . . written first into the following division block as clearly shown in FIG. 5. In other words, dot-inversion driving is achieved in the entire pixel area.

FIG. 5 shows signal-voltage write conditions in pixels in divided-by-three time-division driving shown in FIG. 4. In FIG. 5, the horizontal direction indicates a scanning order and the vertical direction indicates the order in which the time-division switches operate. A high-voltage write condition is indicated by H, and a low-voltage write condition is indicated by L.

Figures 8, 9:
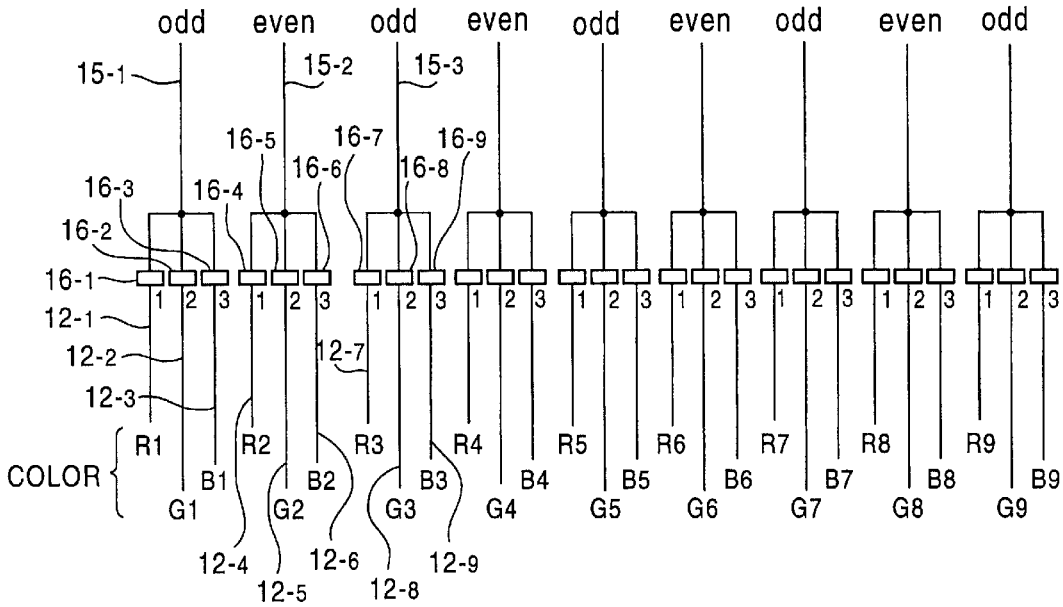
FIG. 8 is a configuration view showing the connections of time-division switches in second divided-by-three time-division driving according to the first embodiment.
FIG. 9 is a view showing signal-voltage write conditions on pixels in the second divided-by-three time-division driving.

FIG. 8 is a configuration view showing a second example of the connections of the time-division switch section 16. This view, for example, shows a second example applied to divided-by-three time-division driving corresponding to R, G, and B. In this example, the driver IC 14 time-sequentially outputs signal potentials for three R, G, and B pixels from output terminals through the output lines 15-1, 15-2, 15-3, . . .

Figure 10:
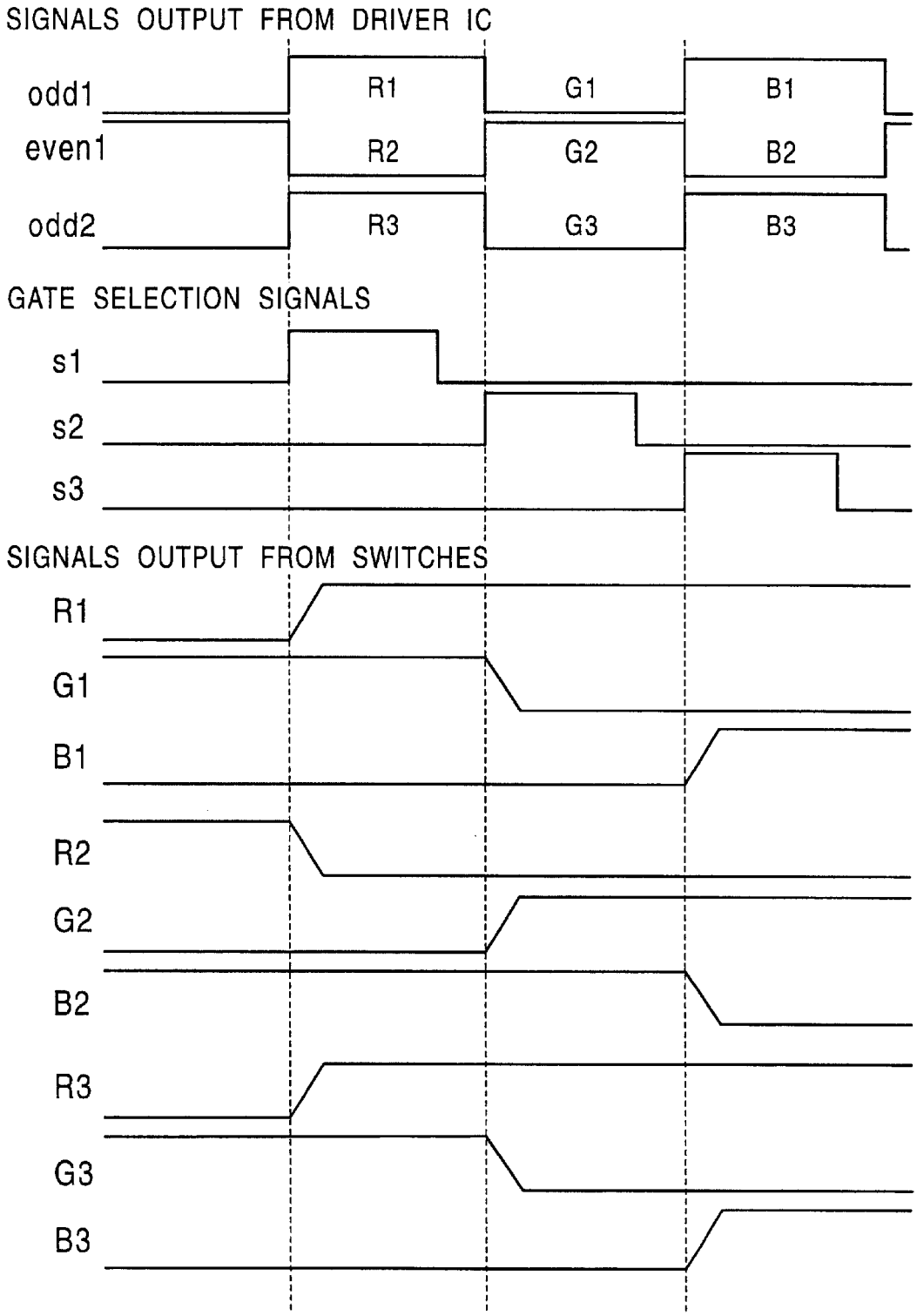
FIG. 10 is a timing chart of each signal in the second divided-by-three time-division driving.

Specifically, as shown in a timing chart of FIG. 10, the driver IC 14 outputs a signal for R1, G1, and B1 pixels from an odd-numbered output terminal through the output line 15-1, a signal for R2, G2, and B2 pixels from an even-numbered output terminal through the output line 15-2, a signal for R3, G3, and B3 pixels from an odd-numbered output terminal through the output line 15-3. . .

Time-division switches 16-1, 16-2, and 16-3 are provided between the output line 15-1 and three signal lines 12-1, 12-2, and 12-3, time-division switches 16-4, 16-5, and 16-6 are provided between the output line 15-2 and three signal lines 12-4, 12-5, and 12-6, time-division switches 16-7, 16-8, and 16-9 are provided between the output line 15-3 and three signal lines 12-7, 12-8, and 12-9, . . .

These time-division switches 16-1, 16-2, 16-3, 16-4, 16-5, 16-6, 16-7, 16-8, 16-9, . . . are formed in the same way as in the previous application example in the LCD panel 10 by polycrystalline TFTs having a gate structure shown in FIG. 7A or FIG. 7B. These time-division switches are sequentially turned on according to gate selection signals s1, s2, and s3 (see the timing chart of FIG. 10) sent from the outside to divide by three in one horizontal scanning period time-sequential signals output from the driver IC 14 through the output lines 15-1, 15-2, 15-3, . . . and to send them to the corresponding signal lines.

Also in the divide-by-three time-division driving described above, since a time-division number is odd, signal voltages B1, B2, . . . written last into division blocks have different polarities from signal voltages A2, A3, . . . written first into the following division blocks as clearly shown in FIG. 9. In other words, dot-inversion driving is achieved in the entire pixel area. Since an R output is followed by a G output, and then by a B output as clearly shown in FIG. 10, signal rotation is not required for the signal potentials output from the external driver IC 14 and complicated data re-arrangement is not required, either, in the same way as in the previous application example.

FIG. 9 shows signal-voltage write conditions in pixels in the divided-by-three time-division driving shown in FIG. 8. In FIG. 9, the horizontal direction indicates a scanning order and the vertical direction indicates the order in which the time-division switches operate. A high-voltage write condition is indicated by H, and a low-voltage write condition is indicated by L.

Since complete dot-inversion driving is achieved in the active-matrix LCD apparatus employing dot inversion driving even if time-division driving is applied, as described above, the numbers of horizontal driving circuits and their output ICs in the LCD apparatus are not increased but reduced when the apparatus is used with display methods which have been increasing in display pixels such as super XGA (SXGA) and ultra XGA (UXGA). Stable, good image quality is provided in dot inversion display. An LCD apparatus according to the present invention can be made compact as an LCD module and multi-color display is implemented with an inexpensive LCD panel.

In the above application examples, the time-division number is set to three. The time-division number is not limited to three. When it is set to the n-th power of three (n: natural number) such as nine and 27, inverted signals output from odd-numbered terminals and even-numbered terminals of the driver IC 14 are synchronized with the inversion signals corresponding to pixel arrangement in each time division.

Figures 11, 12:
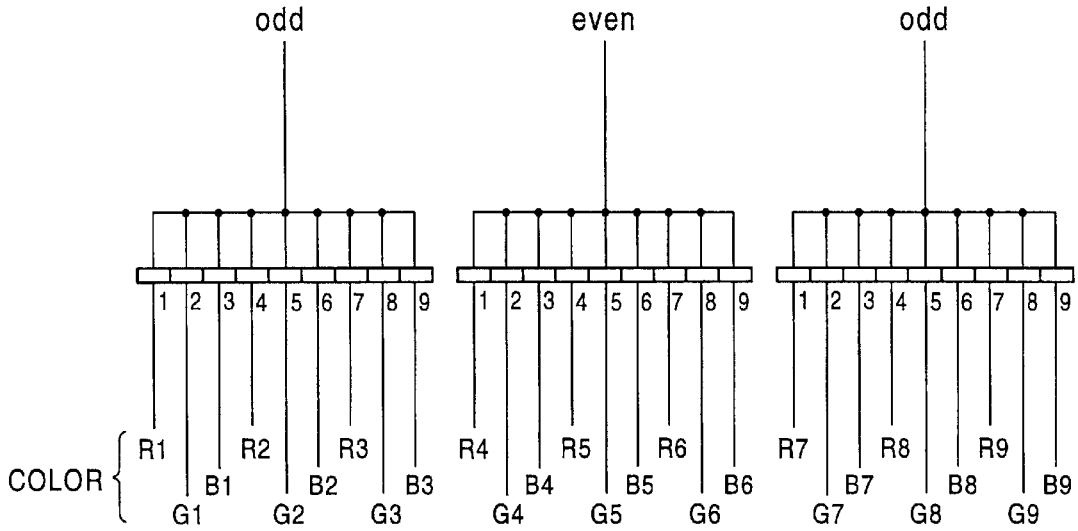
FIG. 11 is a configuration view showing the connections of time-division switches in divided-by-nine time-division driving according to the first embodiment.
FIG. 12 is a view showing signal-voltage write conditions on pixels in the divided-by-nine time-division driving.

FIG. 11 is a configuration view showing a case in which divided-by-nine time-division driving is applied. FIG. 12 shows signal-voltage write conditions in pixels in the divided-by-nine time-division driving. Also in the divide-by-nine time-division driving, since the time-division number is odd, it is clearly understood from FIG. 12 that signal voltages B1, B2, . . . written last into division blocks have different polarities from signal voltages A2, A3, . . . written first into the following division blocks, and dot-inversion driving is achieved in the entire pixel area.

Since signals are handled in units of R, G, and B pixels with the time-division number being set to the n-th power of three, signal processing becomes simple and the amount of memory data can be reduced in a signal processing system. The present invention is not limited to a case in which the time-division number is set to the n-th power of three. The time-division number is set odd to implement dot inversion in the entire pixel area.

Figures 13, 14:
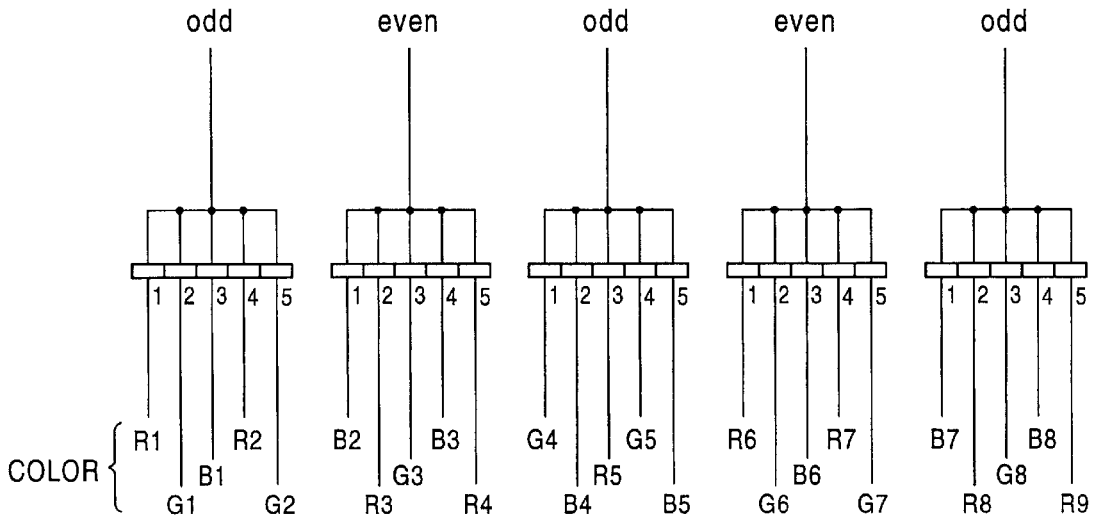
FIG. 13 is a configuration view showing the connections of time-division switches in divided-by-five time-division driving according to the first embodiment.
FIG. 14 is a view showing signal-voltage write conditions on pixels in the divided-by-five time-division driving.

FIG. 13 is a configuration view showing a case in which divided-by-five time-division driving is applied. FIG. 14 shows signal-voltage write conditions in pixels in the divided-by-five time-division driving. Also in the divide-by-five time-division driving, since the time-division number is odd, it is clearly understood from FIG. 14 that signal voltages B1, B2, . . . written last into division blocks have different polarities from signal voltages A2, A3, . . . written first into the following division blocks, and dot-inversion driving is achieved in the entire pixel area.

In the above first embodiment, under a prerequisite condition of dot-inversion driving, the time-division number is set odd, especially set to the n-th power of three to implement complete dot-inversion driving. Not only in dot-inversion driving but also in common (VCOM) inversion driving or 1H inversion driving, divide-by-three time-division driving corresponding to R, G, and B implements time-division driving without causing image-quality deterioration.

The common (VCOM) inversion driving refers to a driving method in which a common voltage VCOM applied to the opposite electrode of each pixel in common is alternately inverted every 1H. 1H inversion driving refers to a driving method in which the polarity of image data sent to each pixel is inverted against a common voltage VCOM every 1H.

A second embodiment of the present invention to which common (VCOM) inversion driving is applied will be described below.

Figure 15:
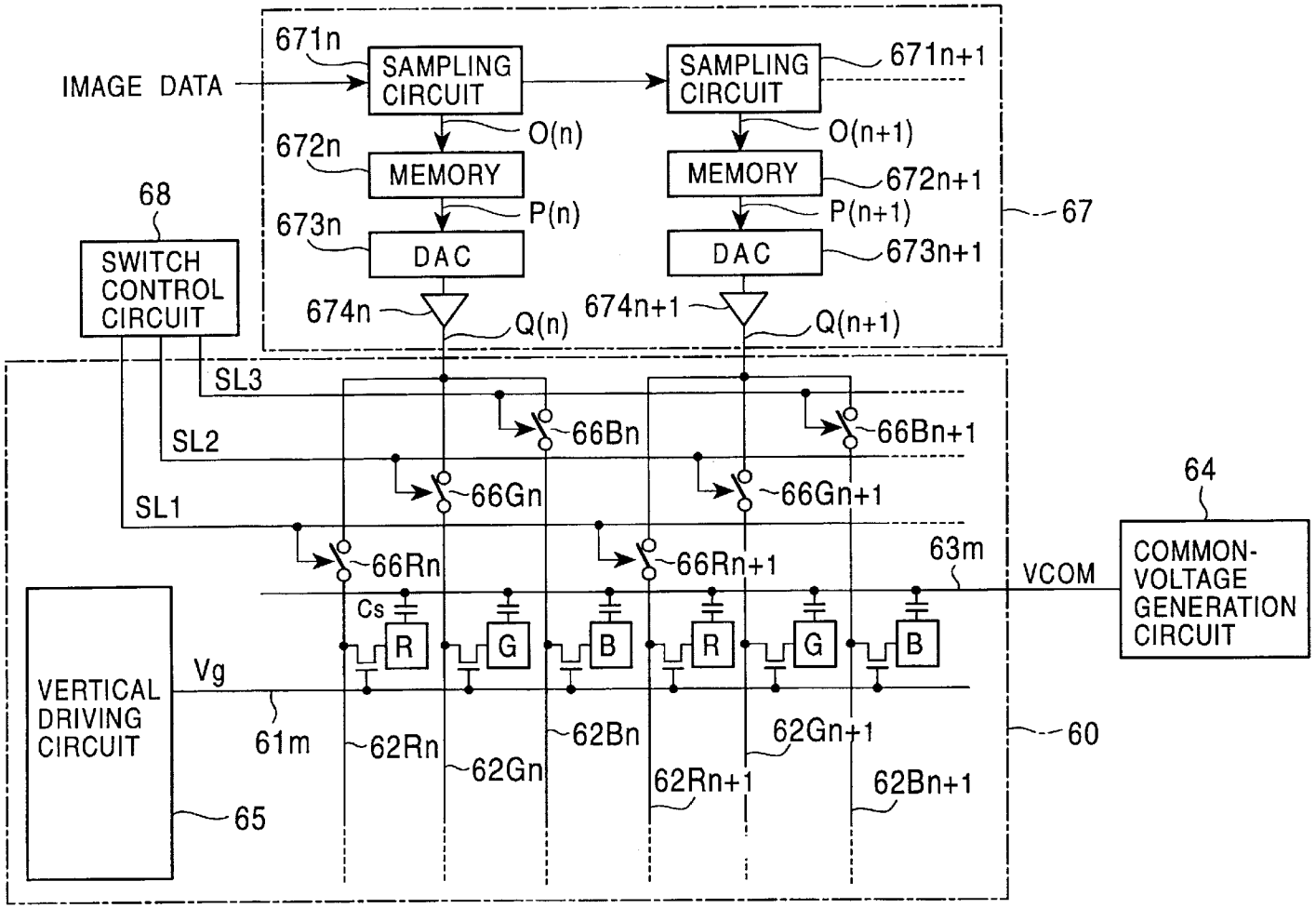
FIG. 15 is a rough configuration view of an active-matrix liquid-crystal display apparatus according to a second embodiment of the present invention.

FIG. 15 is a rough configuration view of an active-matrix LCD apparatus according to a second embodiment of the present invention. The configuration of the active-matrix LCD apparatus according to the second embodiment is basically the same as that of the active-matrix LCD apparatus according to the first embodiment.

In the effective screen area of a color LCD panel 60, groups of three R, G, and B dots disposed at intersections of gate lines 61*m*−1, 61*m*, 61*m*+1, . . . and R, G, and B signal lines 62Rn, 62Gn, 62Bn, . . . form pixels. A common-voltage generation circuit 64 applies a common voltage VCOM alternately inverted, for example, every 1H to the opposite electrodes of the pixels by Cs lines 63*m*−1, 63*m*, 63*m*+1. Common (VCOM) inversion driving is thus implemented.

One end of each of the gate lines 61*m*−1, 61*m*, 61*m*+1, . . . is connected to the output end in the corresponding row in a vertical driving circuit 65. The vertical driving circuit 65 is disposed on the same substrate (a transparent insulating substrate such as a glass substrate) as the color LCD panel 60, and sends selection pulses in the order of the gate lines to select pixels in units of rows for vertical scanning.

On the substrate on which the color LCD panel 60 is disposed, the analog switches 66Rn, 66Gn, 66Bn, . . . corresponding to the signal lines 62Rn, 62Gn, 62Bn, . . . are further formed. These analog switches 66Rn, 66Gn, 66Bn, are also made from polycrystalline TFTs having a gate structure shown in FIG. 7A or 7B in the same way as in the first embodiment.

One end of each of the analog switches 66Rn, 66Gn, 66Bn, . . . is connected to the corresponding signal line 62Rn, 62Gn, 62Bn, or . . . , and the other end is connected in common with three R, G, and B switches being handled as one set. In other words, ends of each set are connected in common in such a manner that ends of the analog switches 66Rn, 66Gn, and 66Bn are connected in common as a set, and ends of the analog switches 66Rn+1, 66Gn+1, and 66Bn+1 are connected in common as another set.

These analog switches 66Rn, 66Gn, 66Bn, . . . are connected to the corresponding output ends of a driver IC 67 at the common connection points of the sets, and are turned on (closed) and off (open) in the order of R, G, and B by switch control pulses SL1, SL2, and SL3 output from a switch control circuit 68. The outputs of the driver IC 67 are thus divided and sent to three R, G, and B signal lines, such as the signal lines 62Rn, 62Gn, and 62Bn. The analog switches 66R, 66G, 66B serve as time-division switches.

The switch control circuit 68 may be formed on an external substrate separated from the substrate for the, color LCD panel 60, together with the driver IC 67 by a single-crystal silicon chip. Alternatively, the switch control circuit 68 may be formed on the substrate on which the color LCD panel 60 is disposed, by polycrystalline TFTs.

The driver IC 67 includes sets of circuits, each for three signal lines 62R, 62G, and 62B for vertical pixel columns in the color LCD panel 60. Specifically, a set of circuits for the n-th column, for example, is formed of a sampling circuit 671*n* for sampling input image data, a memory 672*n* for holding the image data sampled by the sampling circuit 671*n*, a D-A converter 673*n* for digitizing the data held by the memory 672*n*, and an output circuit 674*n*.

In the driver IC 67, the sampling circuit 671*n* corresponds to the horizontal shift register circuit 31, the sampling switch set 32, and the level shifting circuit 33 in FIG. 3, the memory 672*n* corresponds to the data latch circuit 34, and the D-A converter 673*n* corresponds to the digital-analog conversion circuit 35. The circuit section corresponding to the output circuit 674*n* is omitted in FIG. 3.

Since, with the use of divide-by-three time-division driving implemented by the analog switches 62Rn, 62Gn, 62Bn, . . . , the driver IC 67 only needs to have one set of a sampling circuit 671, a memory 672, a D-A converter 673, and an output circuit 674 for three signal lines 62R, 62G, and 62B, the driver IC 67 requires a smaller space, is made more inexpensive, and needs less power consumption.

The driver IC 67 sequentially samples input image data at an interval of 1H (one horizontal scanning period), and writes the image data into the pixels of the row selected by the vertical driving circuit 65. The image data input to the driver IC 67 is inverted in polarity every 1H against the common voltage VCOM. In this way, 1H inversion driving is implemented.

In addition to this 1H inversion driving, common inversion driving is implemented by generating the common voltage VCOM alternately inverted every 1H by the common-voltage generation circuit 64, as described above. With common inversion driving being used together with 1H inversion driving, the common voltage VCOM is inverted every 1H in polarity and alternate inversion driving is performed. Since the power voltage of the driver IC 67 can be reduced, low power consumption and low cost become possible.

An operation of the active-matrix LCD apparatus according to the second embodiment will be described next by referring to a timing chart shown in FIG. 16.

Image data input to the driver IC 67 includes R, G, and B data arranged in series in 1H. The image data is sampled (O(n)) three times in 1H for the R, G, and B data by the sampling circuit 671, held (P(n)) by the memory 672, and output (Q(n)) through the D-A converter 673 and the output circuit 674. These signals have the same polarity as the common voltage VCOM within 1H.

The output (Q(n)) of the driver IC 67 is inverted in polarity every 1H. It is divided and sent to three signal lines 62R, 62G, and 62B by turning on (closed) and off (open) control of the analog switches (time-division switches) 66R, 66G, and 66B caused by the switch control pulses SL1, SL2, and SL3 sent from the switch control circuit 68.

Figure 16:
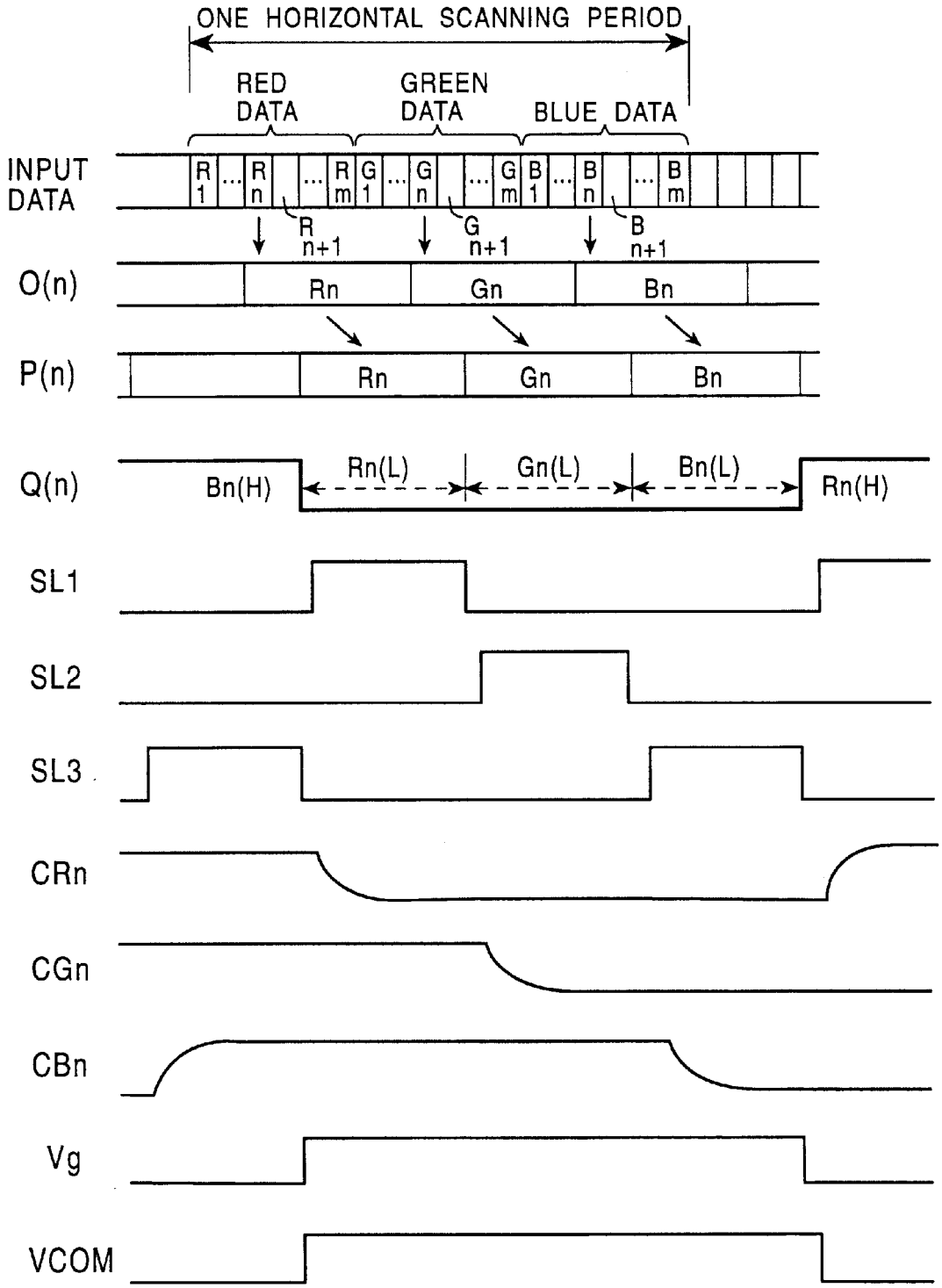
FIG. 16 is a timing chart of operations of the active-matrix liquid-crystal display apparatus according to the second embodiment.
Figure 17:
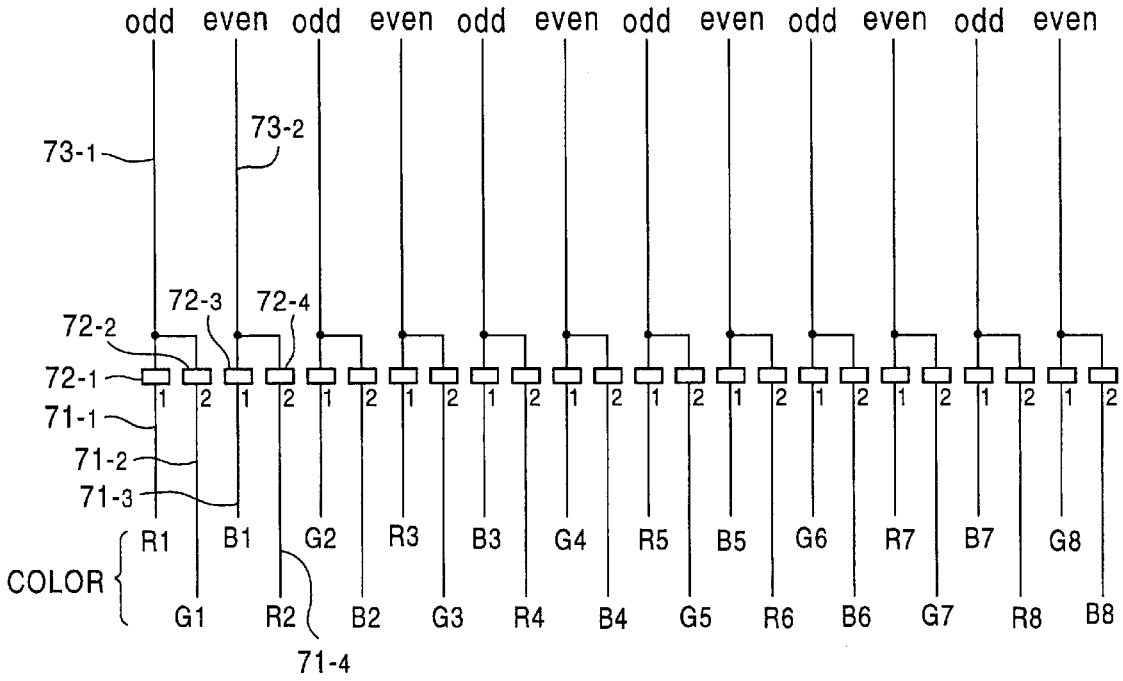
FIG. 17 is a configuration view showing the connections of time-division switches in first divided-by-two time-division driving.
Figure 18:
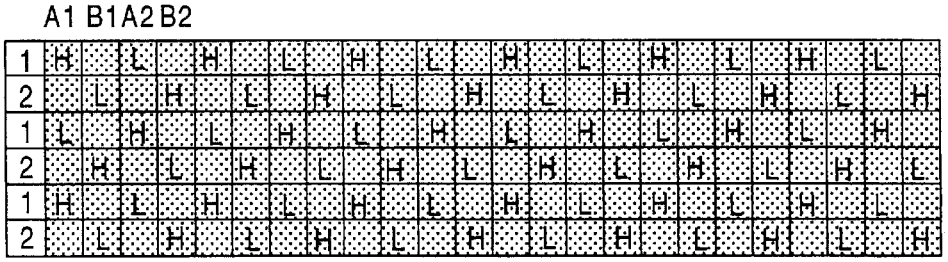
FIG. 18 is a view showing signal-voltage write conditions on pixels in the first divided-by-two time-division driving.
Figure 19:
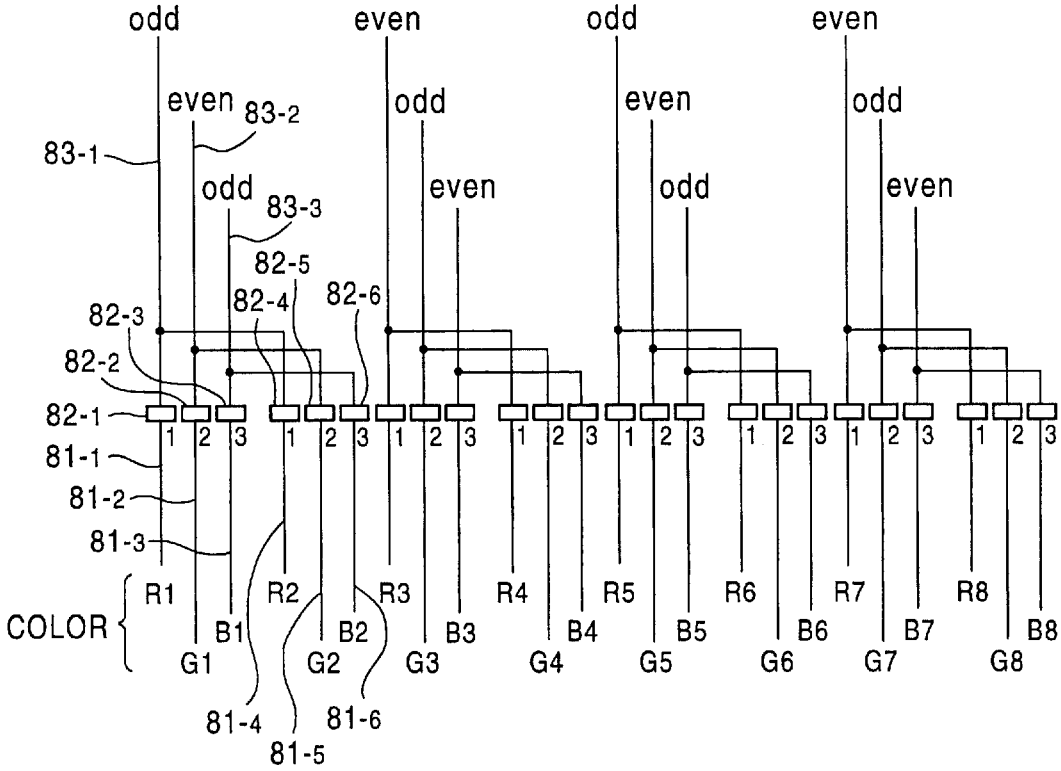
FIG. 19 is a configuration view showing the connections of time-division switches in second divided-by-two time-division driving.
Figure 20:
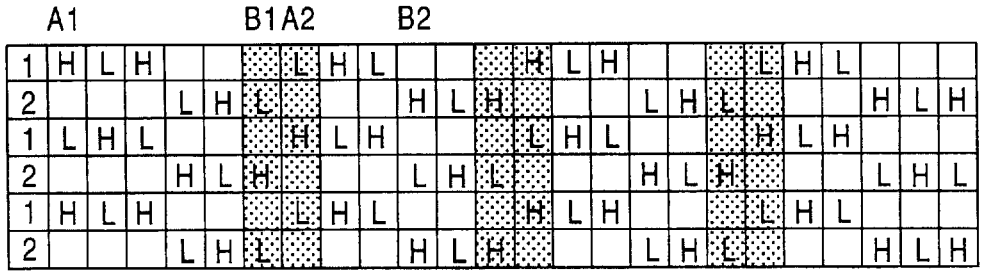
FIG. 20 is a view showing signal-voltage write conditions on pixels in the second divided-by-two time-division driving.

As a result, with the n-th column being taken as an example, the potentials CRn, CGn, and CBn of the R, G, and B signal lines 62Rn, 62Gn, and 62Bn change as shown in FIG. 16, and the display data is written into the signal lines 62Rn, 62Gn, and 62Bn. The vertical driving circuit 65 performs vertical scanning and the written display data is written into the pixels on the row selected by a selection pulse Vg.

In this embodiment,-common (VCOM) inversion driving in which the polarity of the common voltage (VCOM) is inverted every 1H is applied. When the common voltage VCOM is fixed to a certain DC voltage, 1H inversion driving is implemented. 1H inversion driving can also be applied.

Since the time-division number is set to three corresponding to R, G, and B in common (VCOM) inversion driving or 1H inversion driving as described above, the following advantages are obtained.

The potentials written into the signal lines 62R, 62G, and 62B by the switch control pulses SL1, SL2, and SL3 sent from the switch control circuit 68 shift due to the effect of various capacitance coupling in the LCD panel 60 in a high-impedance period after the analog switches 66R, 66G, and 66B are opened. The potential last written into each pixel is determined at the instant when the selection pulse Vg sent from the vertical driving circuit 65 falls.

Therefore, as a result, the potential of the pixel corresponding to the signal line written first in a horizontal scanning period differs from that of the pixel corresponding to the signal line written last. Consequently, in divide-by-two time-division driving, described before, since one pixel does not correspond to one set of R, G, and B, the fluctuations of the potentials of the signal lines for each color are not constant and a problem may occur in terms of the sense of sight, such as color unevenness (vertical stripe) in the vertical direction.

On the other hand, as in the present embodiment, when the time-division number is set to three corresponding to R, G, and B, and data written into signal lines at different timing correspond to R, G, and B, the fluctuations of the potentials of the signal lines in each color is almost constant. In other words, the potentials fluctuate in colors, and this potential difference does not appear as a luminance difference. In terms of the sense of sight, only a minute color difference appears, and it practically causes no problem.

As described above, according to the present invention, when time-division driving, which allows the number of output pins of a driver IC to be reduced, is applied to an active-matrix LCD apparatus, since the time-division number is set to an odd number, voltages having different polarities can be applied to adjacent dots (pixels) in one line. Therefore, even if time-division driving is applied, complete dot-inversion driving can be performed. Flickers are reduced and a contrast difference between lines in liquid crystal is eliminated. Consequently, time-division driving is implemented without reducing image quality.

What is claimed is:

1. A liquid-crystal display apparatus comprising:

a display section including a plurality of row gate lines, a plurality of column signal lines, and a plurality of pixels two-dimensionally arranged at the intersections of the plurality of row gate lines and the plurality of column signal lines;

a transparent substrate on which said display section is formed, a second transparent substrate having an opposite electrode, connected to said transparent substrate with a predetermined gap placed therebetween;

liquid crystal held in the gap;

a driver circuit for outputting a time-sequential signal corresponding to a predetermined time-division number; and a time-division switch for time-dividing the time-sequential signal output from said driver circuit according to the predetermined time-division number and for sending the time-divided time-sequential signal output to the corresponding signal lines among said plurality of column signal lines, wherein the time-division number used in said time-division switch is set odd.

2. A liquid-crystal display apparatus according to claim 1, wherein the time-division number used in said time-division switch is set to 3n (n: natural number).

3. A liquid-crystal display apparatus according to claim 1, wherein the time-division number used in said time-division switch is set to the n-th (n: natural number) power of three.

4. A liquid-crystal display apparatus according to claim 1, wherein the time-division number used in said time-division switch is set to three corresponding to red, green, and blue in a case in which three red, green, and blue dots form one pixel.

5. A liquid-crystal display apparatus according to claim 1, wherein said driver circuit is a driver IC disposed outside said transparent substrate on which said display section is formed.

6. A liquid-crystal display apparatus according to claim 1, wherein said driver circuit outputs signals having opposite polarities from odd-numbered output terminals and even-numbered output terminals.

7. A liquid-crystal display apparatus according to claim 1, wherein said driver circuit outputs signals having opposite polarities in alternate horizontal scanning periods.

8. A liquid-crystal display apparatus according to claim 7, wherein the polarity of a common voltage applied to the opposite electrode is inverted every horizontal scanning period.

9. A liquid-crystal display apparatus comprising:

a liquid crystal display portion including a plurality of signal lines;

a driver circuit for outputting a time-sequential signal corresponding to a predetermined time-division number; and a time-division switch for time-dividing the time-sequential signal output from said driver circuit according to the predetermined time-division number and for sending the time-divided time-sequential signal output to corresponding signal lines among said plurality of signal lines;

wherein the time-division number used in said time-division switch is set odd.

10. The liquid-crystal display apparatus according to claim 9, wherein the time-division number used in said time-division switch is set to 3n, n being a natural number.

11. The liquid-crystal display apparatus according to claim 9, wherein the time-division number used in said time-division switch is set to the n-th power of three, n being a natural number.

12. The liquid-crystal display apparatus according to claim 9, wherein the time-division number used in said time-division switch is set to three to correspond to red, green, and blue.

13. The liquid-crystal display apparatus according to claim 12, wherein the liquid crystal display portion includes a plurality of pixels, and wherein each pixel is formed by a red dot, a green dot, and a blue dot.

14. The liquid-crystal display apparatus according to claim 9, wherein the driver circuit is a driver IC disposed outside the liquid-crystal display portion.

15. The liquid-crystal display apparatus according to claim 9, wherein said driver circuit outputs signals having opposite polarities from odd-numbered output terminals and even-numbered output terminals.

16. The liquid-crystal display apparatus according to claim 9, wherein said driver circuit outputs signals having opposite polarities in alternate horizontal scanning periods.

17. The liquid-crystal display apparatus according to claim 16, wherein the polarity of a common voltage applied to an opposite electrode is inverted every horizontal scanning period.

* * * * *